US010940603B2

(12) United States Patent
Masubuchi

(10) Patent No.: US 10,940,603 B2
(45) Date of Patent: Mar. 9, 2021

(54) LABEL PROCESSING APPARATUS AND LABEL PROCESSING METHOD

(71) Applicant: SEIKO EPSON CORPORATION, Tokyo (JP)

(72) Inventor: Hiroyuki Masubuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/486,463

(22) PCT Filed: Jan. 24, 2018

(86) PCT No.: PCT/JP2018/002087

§ 371 (c)(1),
(2) Date: Aug. 15, 2019

(87) PCT Pub. No.: WO2018/150824

PCT Pub. Date: Aug. 23, 2018

(65) Prior Publication Data

US 2019/0359365 A1 Nov. 28, 2019

(30) Foreign Application Priority Data

Feb. 17, 2017 (JP) ..... JP2017-028176
Feb. 17, 2017 (JP) ..... JP2017-028187

(51) Int. Cl.

| | |
|---|---|
| ***B26F 1/24*** | (2006.01) |
| ***B65C 9/00*** | (2006.01) |
| ***B41J 3/407*** | (2006.01) |
| ***B41J 11/66*** | (2006.01) |

(Continued)

(52) U.S. Cl.
CPC ..... *B26F 1/24* (2013.01); *B41J 3/4075* (2013.01); *B41J 11/66* (2013.01); *B65C 9/0015* (2013.01); *B65C 9/46* (2013.01); *B65H 35/00* (2013.01); *B65C 2009/0018* (2013.01)

(58) Field of Classification Search
CPC ..... B41J 2/1714
See application file for complete search history.

(56) References Cited

U.S. PATENT DOCUMENTS 6,464,328 B1 * 10/2002 Hiramatsu ..... B41J 2/1714 347/34
2003/0206211 A1 * 11/2003 Baron ..... B41J 11/663 347/37
2006/0228151 A1 10/2006 Vogel
(Continued)

FOREIGN PATENT DOCUMENTS

JP H04173256 6/1992
JP H06023697 2/1994
(Continued)

*Primary Examiner* — Shelby L Fidler
(74) *Attorney, Agent, or Firm* — Workman Nydegger

(57) ABSTRACT

A label processing apparatus including a head configured to cause a wire pin to move toward and away from a label medium for performing processing on the label medium, a first wall member located at a position in a first direction from the transport path surface including a first communication hole communicating with outside, and a fan configured to blow air onto a ventilation region including a region located at the head side of the first surface in the transport direction, and to then cause the air to be discharged to the outside through the first communication hole.

13 Claims, 14 Drawing Sheets

(51) Int. Cl.
*B65H 35/00* (2006.01)
*B65C 9/46* (2006.01)

(56) References Cited

U.S. PATENT DOCUMENTS

| | | | | |
|---|---|---|---|---|
| 2008/0168873 | A1* | 7/2008 | Yoshimaru | B26D 7/1863 83/102 |
| 2016/0243857 | A1* | 8/2016 | Otsuka | B41J 2/1714 |
| 2017/0136788 | A1 | 5/2017 | Masubuchi et al. | |

FOREIGN PATENT DOCUMENTS

| | | | | |
|---|---|---|---|---|
| JP | 10071596 | A | * | 3/1998 |
| JP | 2001031279 | | | 2/2001 |
| JP | 2001096494 | | | 4/2001 |
| JP | 2001309139 | | | 11/2001 |
| JP | 2003118095 | | | 4/2003 |
| JP | 2004284058 | A | * | 10/2004 |
| JP | 2006055974 | | | 3/2006 |
| JP | 2007022710 | | | 2/2007 |
| JP | 2012183649 | | | 9/2012 |
| JP | 2017087379 | | | 5/2017 |

* cited by examiner

LABEL PROCESSING APPARATUS AND LABEL PROCESSING METHOD

The present application is a 371 nationalization of PCT application number PCT/JP2018 002087 filed on Jan. 24, 2018, which is based on, and claims priority from JP Application Serial Number 2017-028176, filed Feb. 17, 2017, and JP Application Serial Number 2017-028187, filed Feb. 17, 2017, the disclosures of which are hereby incorporated by reference herein in their entirety.

The present disclosure relates to a label processing apparatus and a label processing method.

BACKGROUND

The present disclosure relates to a label processing apparatus and a label processing method. Traditionally, a variety of label processing apparatuses have been used. The label processing apparatuses include one configured to perform punching on a label medium. For example, JP-A-2001-9649 discloses a printing and cutting apparatus (label processing apparatus) configured to make an incision (punching) in a sheet (label medium) to be processed, which is being transported.

An apparatus is also used, which includes a head configured to cause a wire pin to move forward and backward. For example, JP-A-4-173256 discloses a print control apparatus that includes a printer head configured to cause a dot wire (wire pin) to move forward and backward.

SUMMARY

The label processing apparatus such as that disclosed in PTL 1, which is configured to punch a label medium, generates substances such as a large amount of paper powder accompanying with the punching. The apparatus such as that disclosed in PTL 2, which is provided with a head configured to cause a wire pin to move forward and backward, may generate substances such as, specifically, a large amount of paper powder, depending on the usage of the head.

Unfortunately, when the substances such as a large amount of paper powder are generated, in using the traditional air blower alone, such as that disclosed in Patent Document 3, some of the generated substances such as the large amount of paper powder possibly disperses within the apparatus to adversely affect, within the apparatus.

Under such a circumstance, an object of the disclosure is to suppress dispersion of substances generated from a label medium when performing punching on a label.

A label processing apparatus according to a first aspect of the disclosure for achieving the above-described object includes a head configured to cause a wire pin to move toward and away from a label medium, which is being transported, for performing processing on the label medium, a first wall member located further toward a first direction side than a transport path, where the label medium is transported, in a width direction intersecting a transport direction in which the label medium is transported, the first wall member including a first communication hole, and an air blower configured to blow air onto a ventilation region including a region where the head is located and then cause the air to be discharged through the first communication hole.

According to the aspect, the label processing apparatus can cause air to be blown onto the ventilation region including a region where the head is located, and to then be discharged through the first communication hole. Thus, the label processing apparatus can suppress dispersion of substances generated from the label medium when performing punching on a label.

A label processing apparatus according to a second aspect of the disclosure includes, in the first aspect, a second wall member located further toward a second direction side opposite the first direction side than the transport path in the width direction, and a duct cover coupled to the first wall member and the second wall member and extending in a direction intersecting a transport path surface, the duct cover including a first surface, wherein the ventilation region and the first communication hole are located at a side, at which the head is located, of the first surface in the transport direction.

According to the above aspect, the label processing apparatus includes the duct cover coupled to the first wall member including the first communication hole communicating with an outside, and the second wall member, and extending in a direction intersecting the transport path surface, the duct cover including the first surface, wherein the air blower is configured to blow air onto the ventilation region including a region located further toward the head side than the first surface in the transport direction, and to then cause the air to be discharged to the outside through the first communication hole. Accordingly, the label processing apparatus can eject the substances generated from the label medium when performing punching on a label to the outside through the first communication hole, and at the same time, causes the duct cover (first surface) to suppress the substances generated from the label medium to disperse to the side opposite to the first surface. Thus, the label processing apparatus can suppress dispersion of substances generated from the label medium when performing punching on a label.

A label processing apparatus according to a third aspect of the disclosure, wherein in the second aspect, the duct cover includes a second surface coupled to the first wall member and the second wall member and extending in a direction intersecting the transport path surface, and a cover section coupled to the first surface and the second surface, and the head and the ventilation region are located on the inside of the duct cover including the first surface, the second surface, and the cover section.

According to the above aspect, the head being a generation source of the substances generated from the label medium, and the ventilation region being a transfer pathway of the generated substances, are located inside the duct cover constituted by the first surface, the second surface, and the cover section. Thus, the label processing apparatus can in particular, efficiently suppress dispersion of substances generated from the label medium when performing punching on a label.

A label processing apparatus according to a fourth aspect of the disclosure includes, in the third aspect, an ink jet head at an opposite side of the first surface, in the transport direction, from a side at which the head is located, wherein a flow rate of gas leaking through a gap between the transport path surface and the first surface in the duct cover is less than a flow rate of gas leaking through a gap between the transport path surface and the second surface in the duct cover.

According to the above aspect, the label processing apparatus, which further includes an ink jet head, can cause a print processing and a label processing to be performed together.

In addition, the flow rate of gas leaking through the gap on the first surface side, which is on an ink jet head side, is less than the flow rate of gas leaking through the gap on the second surface side being opposite side to the ink jet head side. An ink jet head is susceptible to an adverse effect such as an occurrence of print defect, when generated substances such as paper powder adhere to the ink jet head, however, such a configuration allows the label processing apparatus to efficiently suppress the generated substances moving inside the duct cover to leak to the ink jet head side, and to thus suppress the generated substances from adhering to the ink jet head.

The label processing apparatus of a fifth aspect of the disclosure, wherein in the fourth aspect, the gap between the transport path surface and the first surface in the duct cover is narrower than the gap between the transport path surface and the second surface in the duct cover.

According to the above aspect, the gap on a first surface side being an ink jet head side is set narrower than a gap on a second surface side being opposite side to the ink jet head side. Such a configuration allows the label processing apparatus to easily suppress the generated substances moving inside the duct cover to leak to the ink jet head side, and to thus suppress the generated substances from adhering to the ink jet head.

A label processing apparatus according to a sixth aspect of the disclosure further includes, in any one of the second to fifth aspects, a second communication hole provided in the second wall member to communicate with outside, wherein the air blower is located further toward the second direction side than the transport path, takes in an air from the outside through the second communication hole, and then causes the air to be discharged to the outside through the first communication hole.

According to the above aspect, the label processing apparatus further includes the second communication hole provided through the second wall member to communicate with outside, wherein the air blower located further toward the second direction side than the transport path takes in air from the outside through the second communication hole and then causes the air to be discharged to the outside through the first communication hole. This can cause the label processing apparatus to collect the generated substances on one side (first communication hole side), and to thus facilitate the collection of the generated substances.

A label processing apparatus according to a seventh aspect of the disclosure further includes, in any one of the second to fifth aspects, a second communication hole provided in the second wall member to communicate with the outside, and a third communication hole provided between the first wall member and the second wall member in the width direction to communicate with the outside, wherein the air blower takes in air from the outside through the third communication hole and then causes the air to be discharged to the outside through the first communication hole and the second communication hole.

According to the aspect, the label processing apparatus further includes the second communication hole provided through the second wall member to communicate with the outside, and the third communication hole provided between the first wall member and the second wall member in a width direction to communicate with the outside, wherein the air blower takes in air from the outside through the third communication hole and then causes the air to be discharged to the outside through the first communication hole and the second communication hole. This can cause, even when the ventilation region is spacious, the label processing apparatus to efficiently eject the generated substances to the outside.

A label processing apparatus according to an eighth aspect of the disclosure further includes, in any one of the first to seventh aspects, a blown-substance receptacle configured to accommodate a substance having been blown to the outside, wherein at least a part of the blown-substance receptacle is provided attachably to and detachably from the label processing apparatus.

According to the above aspect, the label processing apparatus, which further includes the blown-substance receptacle configured to accommodate a substance having been blown to an outside, facilitates the collection of the generated substances having been ejected to the outside. In addition, at least a part of the blown-substance receptacle is provided attachably to and detachably from the label processing apparatus, thus facilitating the disposal of generated substances accumulated in the blown-substance receptacle.

A label processing apparatus according to a ninth aspect of the disclosure includes a carriage including the head and configured to perform scanning in a width direction intersecting a transport direction of the label medium, a contact section provided in the carriage and configured to come into contact with the label medium when the carriage performs scanning in the width direction, a collection receptacle configured to accommodate a substance collected by the contact section that moves while being in contact with the label medium as the carriage performs scanning, wherein the contact section is configured, when moving from a position where the contact section comes into contact with a first end of an end portion in the width direction of the label medium to a second end portion side located further toward the collection receptacle side than the first end portion, to move to the collection receptacle, corresponding to the scanning of the carriage.

According to the above aspect, in the label processing apparatus, the carriage that performs scanning in a width direction is provided with the contact section configured to come into contact with a label medium accompanying with the scanning of the carriage. Accordingly, the label processing apparatus can cause substances generated from the label medium when performing punching on a label to be collected by the contact section and accommodated by the collection receptacle, thus suppressing dispersion of the generated substances.

A label processing apparatus according to a tenth aspect of the disclosure, wherein in the ninth aspect, the collection receptacle is provided at a position separated from a transport region, where the label medium is transported, in the width direction, and at least a part of the collection receptacle is provided attachably to and detachably from the label processing apparatus.

According to the above aspect, the collection receptacle is provided at a position separated from the transport region in a width direction, where at least a part of the collection receptacle is provided attachably to and detachably from the label processing apparatus. This can cause the label processing apparatus to lower the possibility of the generated substances reaching the transport region, and to thus facilitate the disposal of the generated substances accumulated in the collection receptacle.

A label processing apparatus according to an eleventh aspect of the disclosure, wherein in the tenth aspect, the contact section is configured, at least in the width direction, to come into contact with the label medium on an opposite side of the head from a side thereof at which the collection receptacle is located.

According to the above aspect, the contact section, at least in a width direction, comes into contact with a label medium on a side opposite, with respect to a head, to a side on which the collection receptacle is located. That is, the contact section is configured to collect the generated substances at the back side of the head in the scanning direction accompanying with the scanning of the carriage. This can cause the label processing apparatus to efficiently collect the substances generated from the label medium when the head performs punching on a label.

A label processing apparatus according to an twelfth aspect of the disclosure, wherein in any one of the ninth to the eleventh aspects, the carriage is configured to perform scanning between a first carriage position where the contact section comes into contact with the first end portion of the label medium and a second carriage position where a part of the contact section faces the collection receptacle.

According to the above aspect, the carriage performs scanning between a first carriage position where the contact section comes into contact with the first end portion and a second carriage position where a part of the contact section faces the collection receptacle. This can cause the label processing apparatus to accommodate the generated substance, collected by the contact section, with the collection receptacle solely due to the scanning of the carriage (without accompanying the movement of the contact section with respect to the carriage in addition to the scanning of the carriage).

A label processing apparatus according to a thirteenth aspect of the disclosure, wherein in any one of the ninth to the twelfth aspects, the contact section is a brush.

According to the above aspect, the contact section, which includes the brush, is simply configured and is attached to the carriage with ease.

A label processing apparatus according to the fourteenth aspect of the disclosure, wherein in any one of the ninth to twelfth aspects, the contact section is a roller member.

According to the above aspect, the contact section, which includes the roller member, can cause an increase in load to be reduced when the carriage performs scanning.

To achieve the above-described object, a label processing method of the disclosure includes transporting a label medium, performing processing on the label medium by moving a wire pin of a head toward and away from the label medium, causing an air blower to blow air, thereby causing paper powder generated in the processing to move to outside a ventilation region including a region where the head is located.

According to the method, the label medium is performed processing by the wire pin of the head, and the paper powder generated in the processing is moved to the outside of the ventilation region including a region to locate the head due to the blowing of the air blower.

DESCRIPTION OF EMBODIMENTS

Hereinafter, a label processing apparatus 1 according to an example of the disclosure will be described in detail with reference to the appended drawings.

Example 1 (FIGS. 1 to 5)

First, an overview of a label processing apparatus 1 according to Example 1 of the disclosure will be given.

Figure 1:
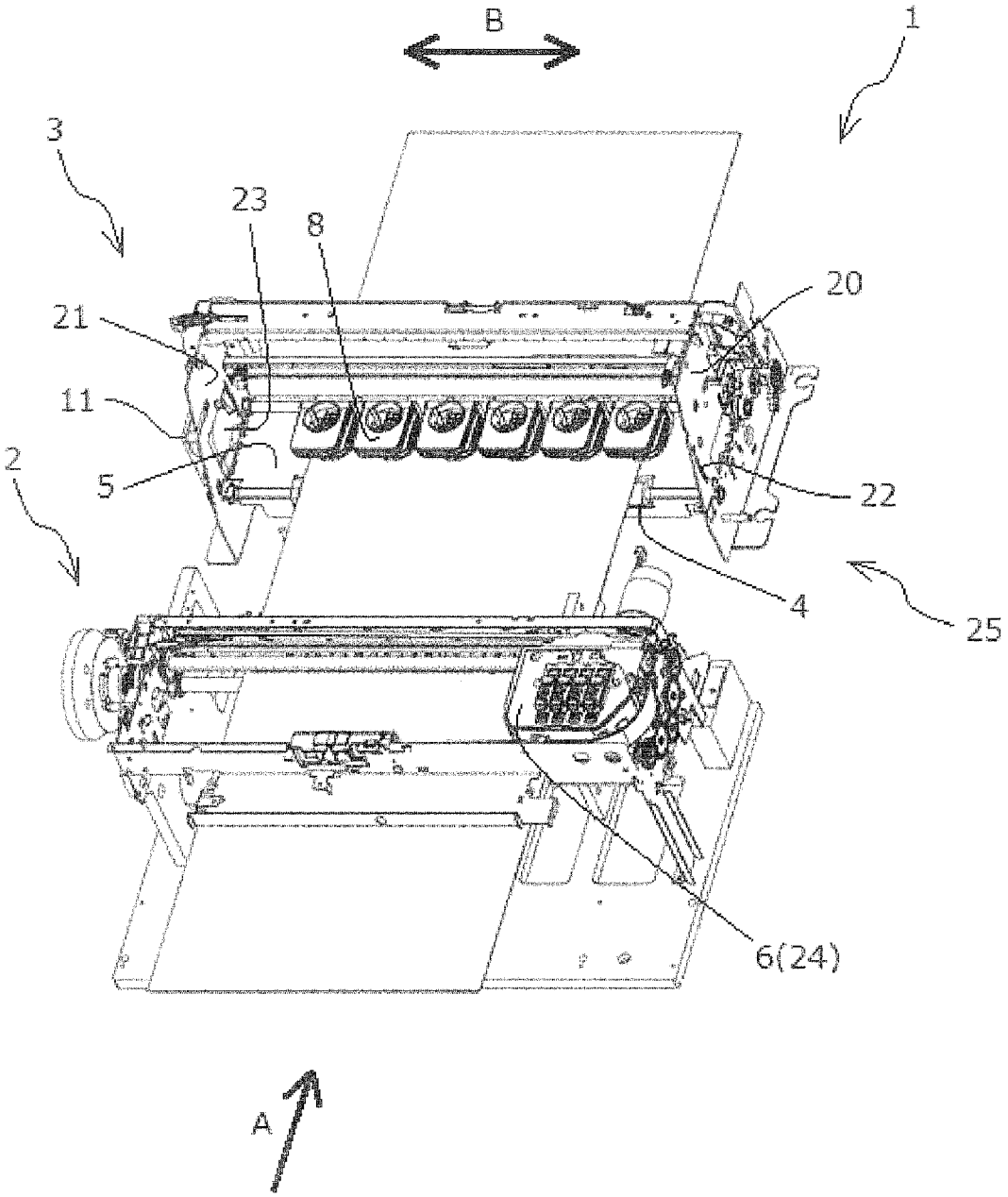
FIG. 1 is a perspective view schematically illustrating a label processing apparatus according to Example 1 of the disclosure.
Figure 2:
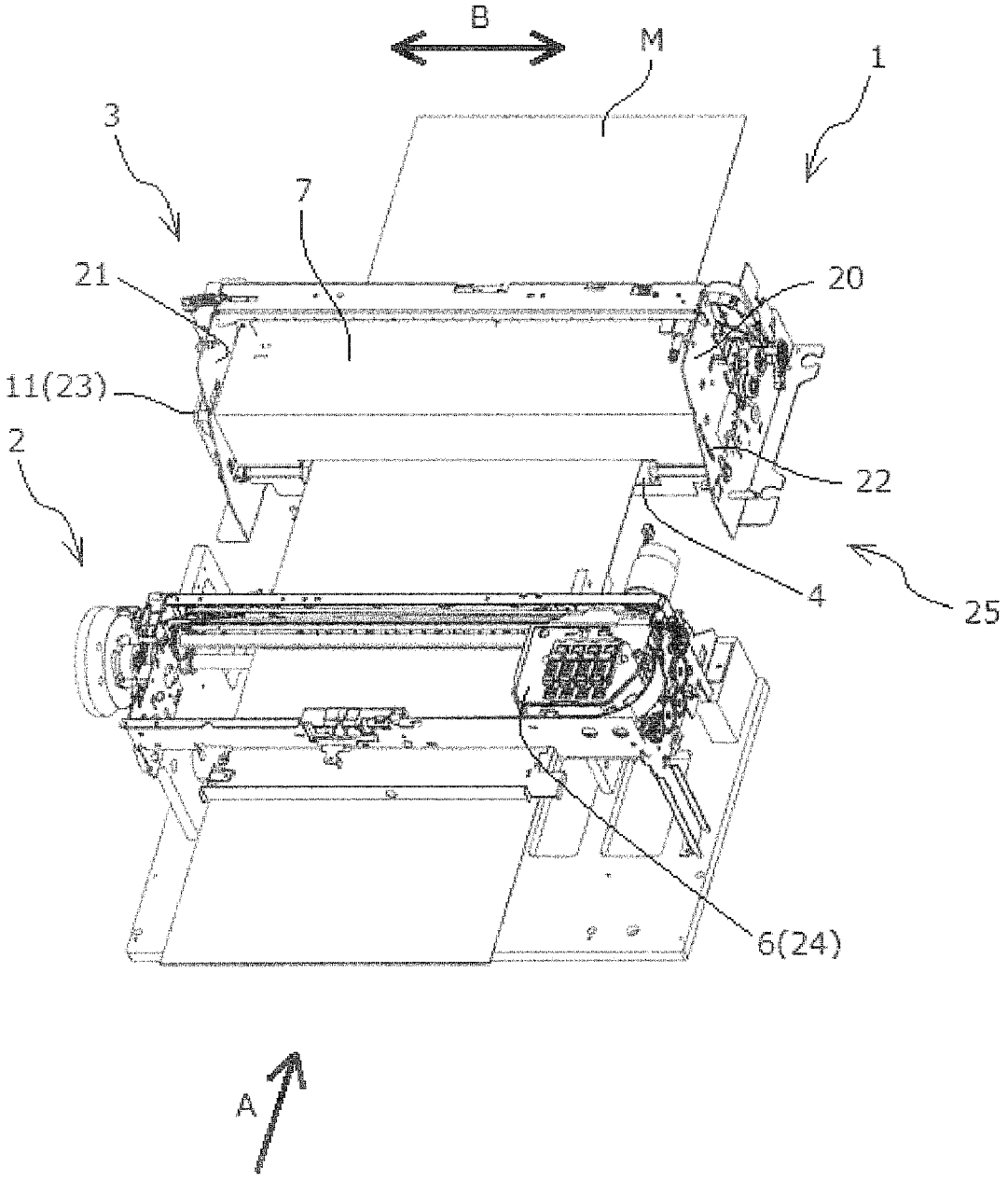
FIG. 2 is a perspective view schematically illustrating a label processing apparatus according to Example 1 of the disclosure.

FIGS. 1 and 2 are perspective views schematically illustrating a label processing apparatus 1 according to Example 1 of the disclosure. FIG. 1 illustrates a state where a duct cover 7 is detached, and FIG. 2 illustrates a state where the duct cover 7 is not detached.

The label processing apparatus 1 includes a printing device 2 configured to perform printing (forming an image) on a label medium M, and a label punching device 3 configured to perform processing (performing a punching process of punching a seal portion out of a board) on the label medium M.

The label processing apparatus 1 also includes a roller 4 configured to transport the label medium M in a transport direction A, and a support section 5 configured to support the label medium M. The label processing apparatus 1 is configured such that the label medium M transported in the transport direction A by the roller 4 is formed an image by the printing device 2, and is then punched by the label punching device 3, corresponding to the position of the image. Note that a suction hole (not illustrated) configured to suppress lifting of the label medium M being transported is formed at a part of the support section 5.

The printing device 2 according to Example 1 includes a carriage 6 including an ink jet head 24 configured to discharge ink, to perform printing, from a nozzle on a nozzle formation surface on which a plurality of nozzles is provided. The carriage 6 is then configured to be moved back-and-forth (to perform reciprocating scanning) in a width direction B that intersects the transport direction A.

The printing device 2 according to Example 1 is configured to discharge ink, to print an image, from the ink jet head 24 onto the label medium M being transported, while causing the carriage 6 to move back-and-forth in the width direction B. The printing device 2 according to Example 1 then repeatedly performs transporting of the label medium M by a predefined amount (by one pass) in the transport direction A, and causes the ink jet head 24 to discharge ink while causing the carriage 6 to move in the width direction B in a state where the label medium M is stopped. This allows the printing device 2 to form a desired image on the label medium M.

Note that the printing device 2 according to Example 1 is what is known as a serial printer configured to perform printing and to alternately perform transporting of the label medium M and scanning of the carriage 6, however, it suffices that the printing device 2 is a device that forms an image on the label medium M. For example, the printing device 2 may also be what is known as a line printer configured to cause a line head to discharge ink, where the line head includes nozzles linearly arranged along a width direction that intersects the transport direction in which the label medium M is transported by the roller 4, and to continuously perform printing, while continuously transporting the label medium M. The printing device 2 may further be a device other than an ink jet printer, such as a transfer printer, for example.

The label punching device 3 according to Example 1 includes a head 8 that causes a wire pin 10 (see FIG. 3) to move toward and away from the label medium M being transported to perform processing on the label medium M. A plurality of the heads 8 are provided in a manner aligned in the width direction B inside the duct cover 7.

The label punching device 3 according to Example 1 is configured to cause the plurality of heads 8 aligned in the width direction B to perform punching on the label medium M being transported across the entire width in the width direction B of the label medium M. Note that, as described above, the printing device 2 according to Example 1 repeatedly performs transporting of the label medium M by a predefined amount in the transport direction A, and causing the ink jet head 24 to discharge ink in a state where the label medium M is stopped. As a result, the label medium M is intermittently transported. The label punching device 3 according to Example 1 performs a punching process in synchronization with the intermittent transportation. That is, the label punching device 3 according to Example 1 performs punching on the label medium M into a desired shape by repeatingly causing the plurality of heads 8 to punch the label medium M in a state where the label medium M is being transported in the transport direction A, and causing driving of the heads 8 to stop in a state where the label medium M is stopped.

Note that the label processing apparatus 1 is configured to intermittently transport the label medium M as described above, but is not limited to such a configuration. For example, the label processing apparatus 1 may be configured such that the printing device 2 is a line printer, and is configured to continuously discharge ink (perform printing operation) while continuously transporting the label medium M, and to continuously perform punching, using the plurality of heads 8, the label medium M is continuously transported. The label processing apparatus 1 may further be configured to provide a constant slack in the label medium M between the printing device 2 and the label punching device 3, and to then separately control transporting of the label medium M in the printing device 2 and transporting of the label medium M in the label punching device 3.

Note that the label processing apparatus 1 (the label punching device 3) performs punching on the label medium M resulting in generation of a large amount of substances such as paper powder. Specifically, it is assumed that the substances generated due to the punching process on the label medium M include an adhesive layer of a label. In this case, the generated substances are more likely to remain on the label medium M. The printing device 2 may occasionally control reverse transporting of the label medium M to adjust the position at which printing starts, and thus the remaining generated substances may disperse.

To address such a case, the label processing apparatus 1 includes the duct cover 7 as a component configured to suppress dispersion of substances generated due to the punching process by the plurality of heads 8. The label processing apparatus 1 then includes an ejection mechanism 25 that ejects the generated substances inside the duct cover 7 to an outside of the label processing apparatus 1.

The ejection mechanism 25, which is a main component of the label processing apparatus 1, will be described below in detail.

Next, the head 8, which is a main component of the label processing apparatus 1, will be described.

Figure 3:
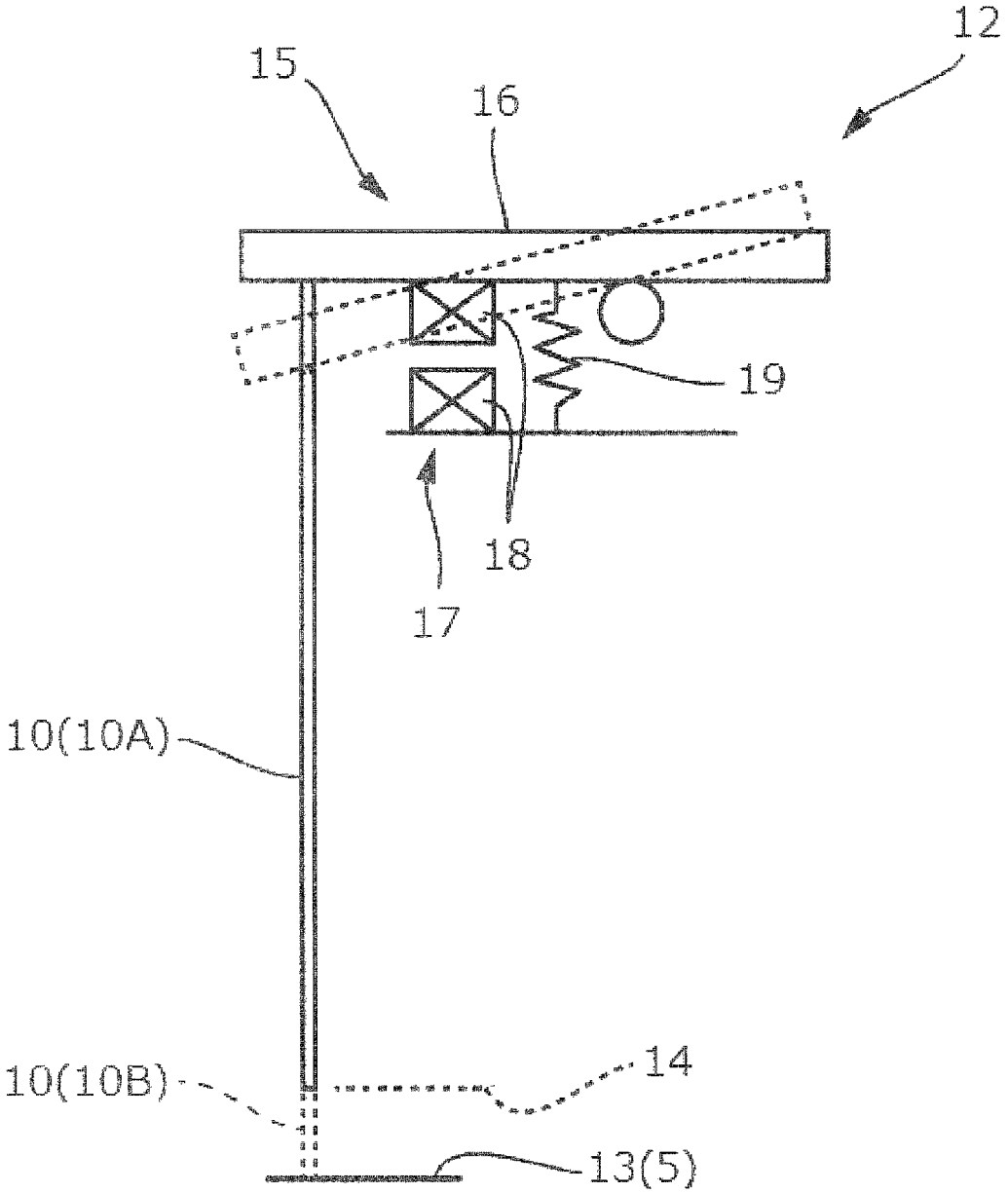
FIG. 3 is a view schematically illustrating a main component of a label processing apparatus according to Example 1 of the disclosure.

Here, FIG. 3 is a view schematically illustrating a wire dot head 12 formed in the head 8.

As illustrated in FIG. 3, the wire dot head 12 includes a plurality of wire pins 10. Each of the wire pins 10 extends perpendicular to a transport path surface 13, which is a part of the support section 5. Each of the wire pins 10 has a rectangular profile shape when viewed from the axial direction of the wire pin 10.

The wire dot head 12 also includes a wire pin movement mechanism 15 that causes each of the wire pins 10 to move forward and backward in a direction approaching to and departing from the transport path surface 13. When the wire pin 10 has moved to a retracted position 10A retracted in a direction departing from the transport path surface 13 (in an upward direction), the leading end of each of the wire pins 10 is located above a head surface 14 of the wire dot head 12. When the wire pin 10 has moved to an advanced position 10B advanced in a direction approaching to the transport path surface 13 (in a downward direction), the leading end of the wire pin 10 protrudes below the head surface 14.

The label punching device 3 threshes the wire pin 10, which is caused to advance by driving the wire pin movement mechanism 15, against the label medium M on the transport path surface 13 to perform punching on the label medium M.

The wire pin movement mechanism 15 includes a drive plate 16 made of metal coupled to the wire pin 10 at an upper (rear) end portion of the wire pin 10, a biasing member 19, such as a coil spring, that biases the wire pin 10 or the drive plate 16 in a direction departing from the transport path surface 13, and an actuator 17 that causes the wire pin 10 to move in a direction approaching the transport path surface 13 against the biasing force of the biasing member 19. The drive plate 16 is swingably supported in the vertical direction. The actuator 17 is of an electromagnetic type equipped with a drive coil 18. The actuator 17 causes the drive plate 16 to be attracted by supplying electric power to the drive coil 18 to make the wire pin 10 to move from the retracted position 10A to the advanced position 10B. When the electric power supply to the drive coil 18 stops and then the actuator 17 stops the attraction of the drive plate 16, the wire pin 10 is moved to the retracted position 10A due to the biasing force of the biasing member 19. A solenoid or the like is used as the actuator 17.

Next, the ejection mechanism 25, which is a main component of the label processing apparatus 1, will be described.

Figure 4:
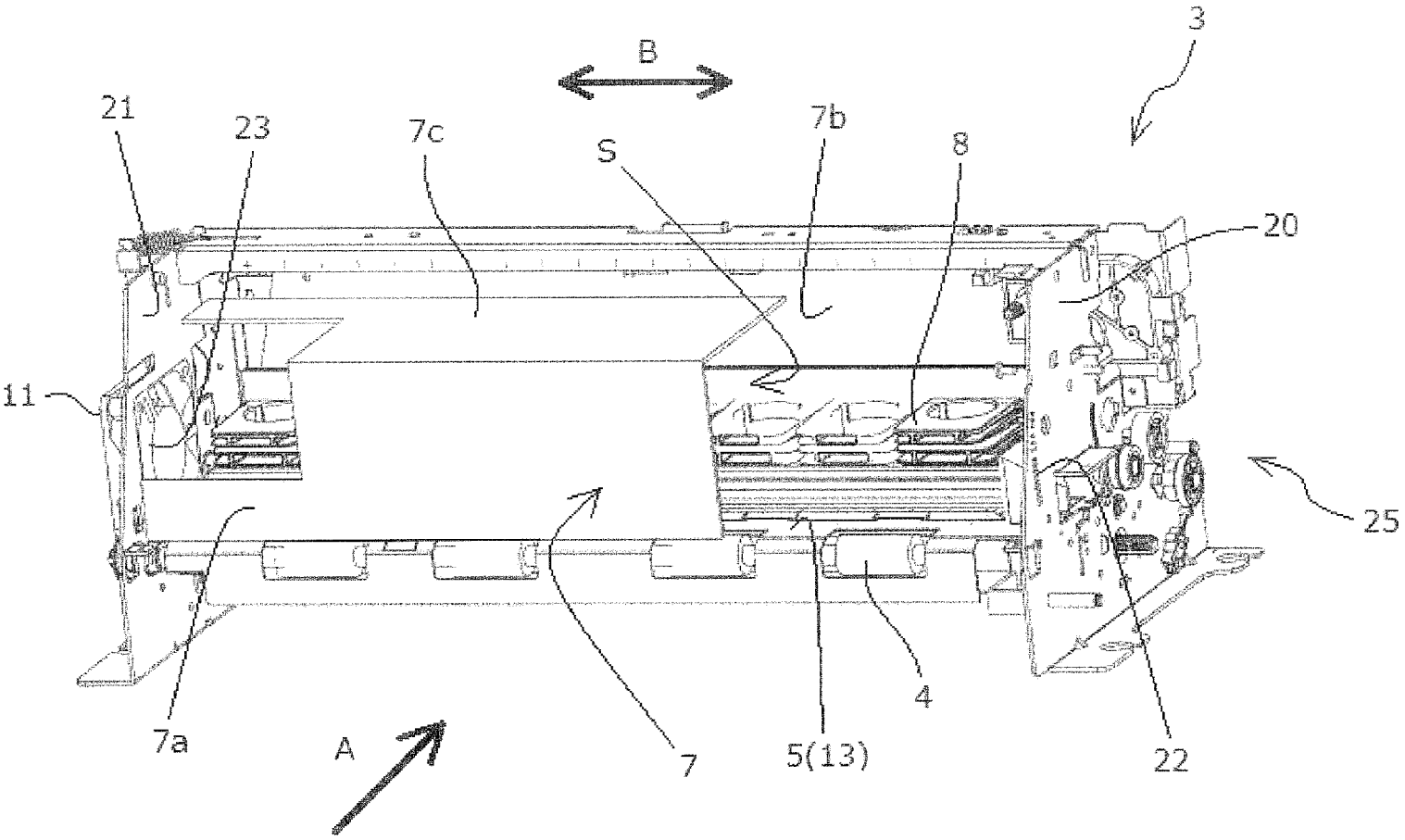
FIG. 4 is a perspective view schematically illustrating a main component of a label processing apparatus according to Example 1 of the disclosure.

Here, FIG. 4 is a perspective view schematically illustrating the label punching device 3 that includes the ejection mechanism 25, which is a main component of the label processing apparatus 1. Note that, in FIG. 4, the duct cover 7 is illustrated in a partially omitted manner to make an internal configuration and the like of the duct cover 7 recognizable.

Figure 5:
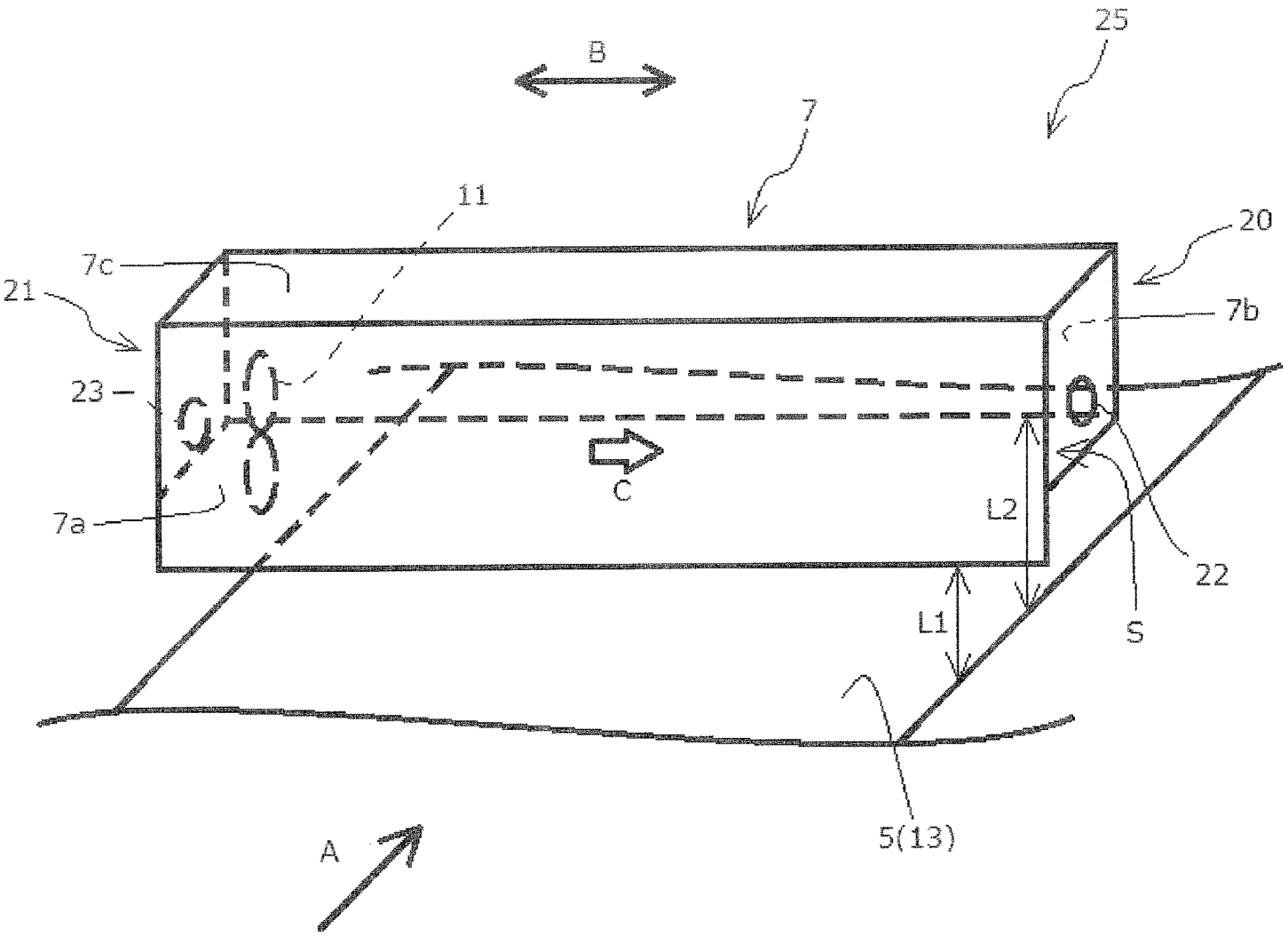
FIG. 5 is a perspective view schematically illustrating a main component of a label processing apparatus according to Example 1 of the disclosure.

FIG. 5 is a perspective view schematically illustrating the ejection mechanism 25, which is a main component of the label processing apparatus 1. Note that, in FIG. 5, a first wall member 20 and a second wall member 21 are illustrated in a partially omitted manner.

The ejection mechanism 25 according to Example 1 is a mechanism configured to remove generated substances (to move generated substances to an outside of the label processing apparatus 1) such as paper powder generated when the label medium M is punched by the head 8. As illustrated in FIGS. 4 and 5, the ejection mechanism 25 according to Example 1 then includes the duct cover 7 that covers the head 8 with a first surface 7*a*, a second surface 7*b*, and a third surface 7*c*, a fan 11, as an air blower, configured to generate an airflow in a ventilation region S being an interior of the duct cover 7, a first communication hole 22 formed through the first wall member 20 of the label punching device 3, and a second communication hole 23 formed through the second wall member 21 of the label punching device 3. As illustrated in FIG. 5, the fan 11 generates an airflow in a direction C directed from the second wall member 21 side toward the first wall member 20 side. This allows air to be taken in through the second communication hole 23, and the air to be ejected (to be discharged) together with the generated substances, through the first communication hole 22, to an outside of the label processing apparatus 1.

To describe in another way, the label processing apparatus 1 includes the head 8 configured to cause the wire pin 10 to move toward and away from the label medium M being transported on the transport path surface 13, and configured to then perform processing on the label medium M. The label processing apparatus 1 also includes a first wall member 20 located on a first direction side (on a right side in Example 1, in a front view) with respect to the transport path surface 13 in the width direction B that intersects the transport direction A in which the label medium M is transported, and including the first communication hole 22 communicating with an outside, and the second wall member 21 located on a second direction side (on a left side in Example 1, in a front view) opposite to the first direction side with respect to the transport path surface 13. The label processing apparatus 1 then includes the duct cover 7 that has the first surface 7*a* and that is coupled to the first wall member 20 and the second wall member 21 and extends in a direction (in a vertical upward direction in Example 1) that intersects the transport path surface 13, and the fan 11 configured to blow air onto the ventilation region S including a region located further toward the head 8 side than the first surface 7*a* in the transport direction A, and to then cause the air to be discharged to an outside through the first communication hole 22.

As such, the label processing apparatus 1 is configured to eject the substances generated from the label medium M when performing punching on a label to the outside of the label processing apparatus 1 through the first communication hole 22, and at the same time, causing the duct cover 7 (the first surface 7*a*) to suppress the generated substances to disperse to the side opposite to the first surface 7*a* (the side on which the printing device 2 is formed). Thus, the label processing apparatus 1 suppresses dispersion of substances generated from the label medium M when performing punching on a label.

The duct cover 7 according to Example 1 includes the second surface 7*b* that is coupled to the first wall member 20 and the second wall member 21 and that extends in a direction that intersects the transport path surface 13, and the third surface 7*c* being a cover section that couples the first surface 7*a* and the second surface 7*b*. The head 8 and the ventilation region S are then located inside the duct cover 7 constituted by the first surface 7*a*, the second surface 7*b*, and the third surface 7*c*.

That is, in the label processing apparatus 1, the head 8 being a generation source of the substances generated from the label medium M, and the ventilation region S being a transfer pathway of the generated substances, are housed inside the duct cover 7 constituted by the first surface 7*a*, the second surface 7*b*, and the third surface 7*c*. Accordingly, the label processing apparatus 1, in particular, efficiently suppresses dispersion of substances generated from the label medium M when performing punching on a label.

As illustrated in FIGS. 1 and 2, the label processing apparatus 1 includes the printing device 2 disposed upstream in the transport direction A, with respect to the label punching device 3. That is, the label processing apparatus 1 includes, in the transport direction A, the ink jet head 24 on a side opposite to a side on which the head 8 is located, relative to the first surface 7*a*. As illustrated in FIG. 5, a gap L1 between the transport path surface 13 and the first surface 7*a* in the duct cover 7 is then set narrower than a gap L2 between the transport path surface 13 and the second surface 7*b* in the duct cover 7.

As such, the label processing apparatus 1 is configured to perform the print processing and the label processing together.

In the duct cover 7, the gap L1 on the side of the first surface 7*a* located on the ink jet head 24 side is set narrower than the gap L2 on the side of the second surface 7*b* located on the side opposite to the ink jet head 24 side. To describe in another way, a probable flow rate of leak gas from the ventilation region S covered by the duct cover 7, on the ink jet head 24 side, is less than that on the side opposite to the ink jet head 24 side. The ink jet head 24 provided for print processing is susceptible to an adverse effect such as an generation of print defect when generated substances such as paper powder adhere to the ink jet head 24. The label processing apparatus 1 reduces an amount of air that leaks from the duct cover 7 to the ink jet head 24 side, and thus lowers the possibility of an occurrence of the generated substances from dispersing due to the leaking air and from adhering to the ink jet head 24.

Note that the label processing apparatus 1 has, but not limited to, such a configuration that the gap L1 is smaller than the gap L2 as a configuration in which the probable flow rate of leak gas from the ventilation region S on the ink jet head 24 side is less than that on the side opposite to the ink jet head 24 side. For example, a configuration may be employed, in which the gap L1, on the first surface 7*a* side, which is on the ink jet head 24 side, is provided with a hair-like member (optionally, a flap structure) configured to suppress gas leakage. Alternatively, a configuration may be employed, in which the hair-like member is disposed in both the gap L1 on the first surface 7*a* side and the gap L2 on the second surface 7*b* side, and the arrangement density of the hairs on the gap L1 side is set higher than the arrangement density of the hairs on the gap L2 side. According to these configurations, the difference in density between the gap L1 side and the gap L2 side creates a difference in the gas flow rate, thus reducing the air flow rate on the gap L1 side.

The label processing apparatus 1 also includes the second communication hole 23 provided through the second wall member 21 to communicate with an outside. The fan 11, which is located on a second direction side (the left side in Example 1, in a front view) with respect to the transport path surface 13, is then configured such that air is taken in from the outside through the second communication hole 23, and the air is discharged to the outside through the first communication hole 22. This allows the label processing apparatus 1 to collect the generated substances on one side (the first communication hole 22 side), thus facilitating the collection of the generated substances to be ejected to the outside of the label processing apparatus 1.

Figure 6:
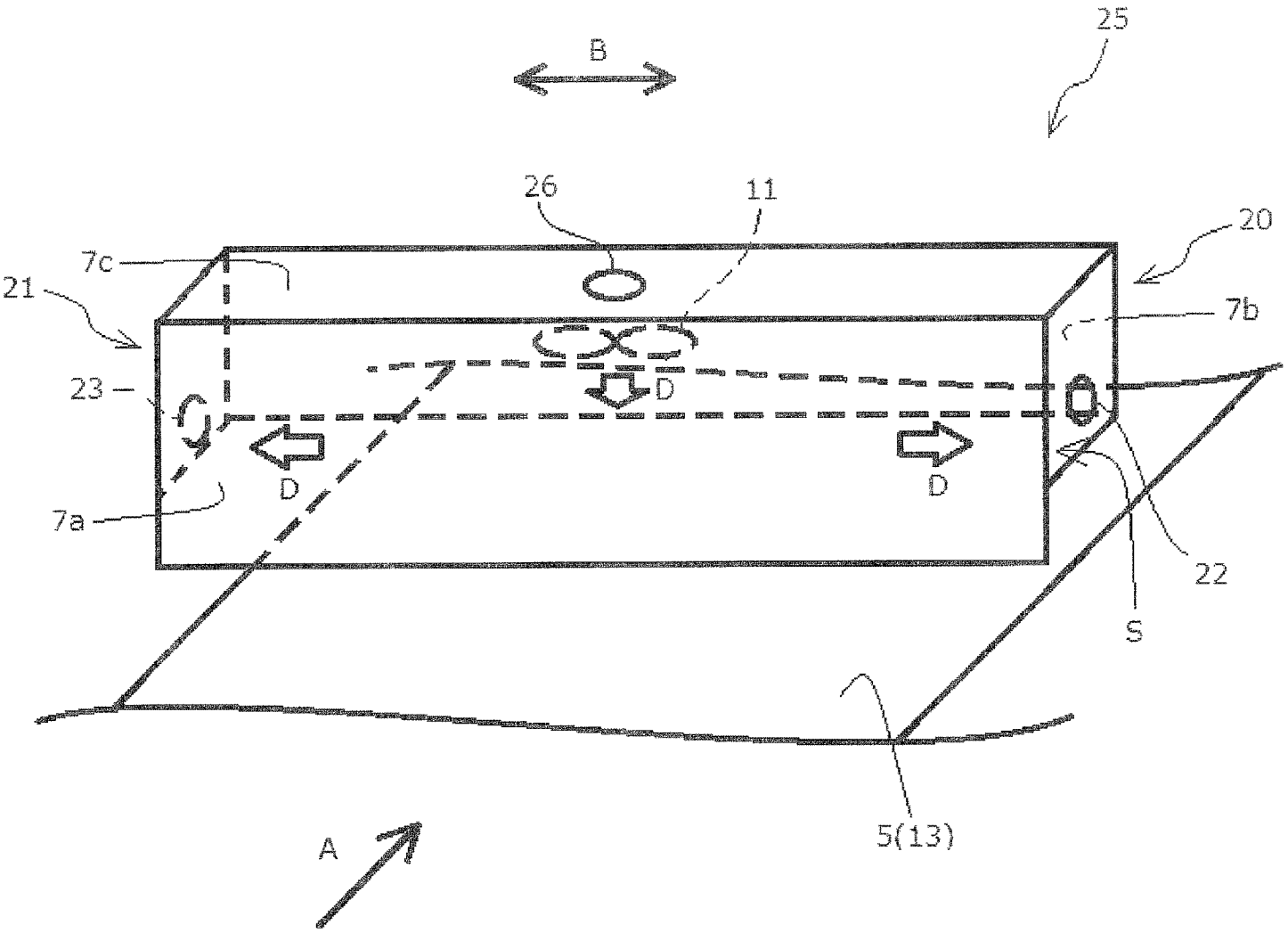
FIG. 6 is a front view schematically illustrating a main component of a label processing apparatus according to Example 2 of the disclosure.

Example 2 (FIG. 6)

Next, a label processing apparatus 1 according to Example 2 will be described in detail with reference to the appended drawings.

FIG. 6 is a perspective view schematically illustrating an ejection mechanism 25, which is a main component of the label processing apparatus 1 according to Example 2, the view corresponding to FIG. 5 that illustrates the label processing apparatus 1 according to Example 1. Like numbers designate identical or corresponding component elements in Example 1, described above, and detailed description for such component elements are omitted.

Note that the label processing apparatus 1 according to Example 2 has a configuration similar to that of the label processing apparatus 1 according to Example 1, excluding the configuration of the ejection mechanism 25.

As illustrated in FIG. 6, the label processing apparatus 1 according to Example 2 includes, as in the label processing apparatus 1 according to Example 1, a third communication hole 26 provided in the third surface 7*c* to communicate with an outside, in addition to the first communication hole 22 provided through the first wall member 20 to communicate with the outside and the second communication hole 23 provided through the second wall member 21 to communicate with the outside. The third communication hole 26 is located between the first wall member 20 and the second wall member 21 in the width direction B. Then, the fan 11 takes in air from the outside through the third communication hole 26, and then generates an airflow in the direction D. This allows the label processing apparatus 1 to cause the air to be discharged to the outside of the label processing apparatus 1 through the first communication hole 22 and the second communication hole 23.

The label processing apparatus 1 efficiently ejects the generated substances to the outside of the label processing apparatus 1. That is, even when the ventilation region S is spacious, the label processing apparatus 1 efficiently ejects the generated substances to the outside of the label processing apparatus 1.

Figure 7:
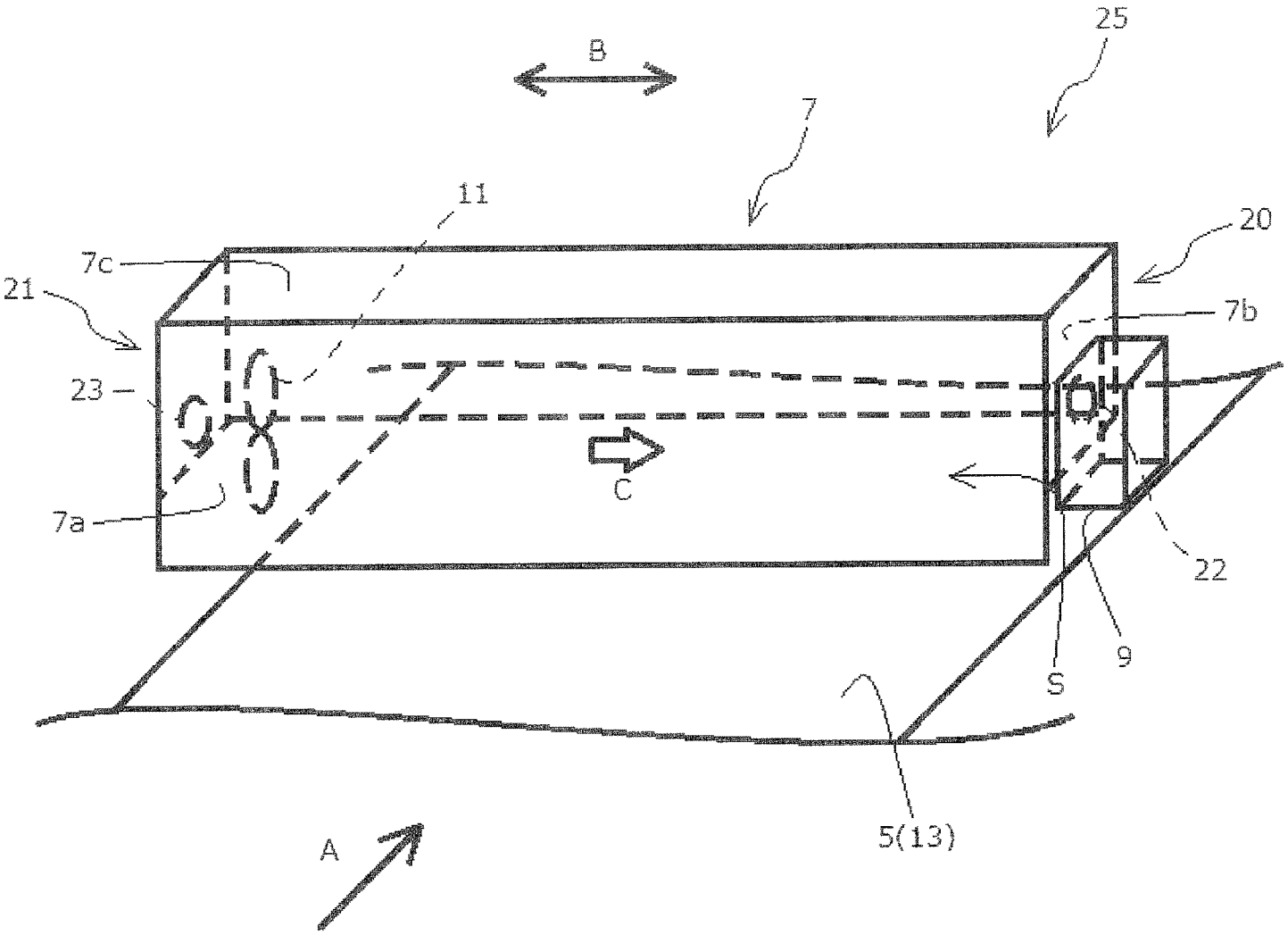
FIG. 7 is a perspective view schematically illustrating a main component of a label processing apparatus according to Example 3 of the disclosure.

Example 3 (FIG. 7)

Hereinafter, a label processing apparatus 1 according to Example 3 will be described in detail with reference to the appended drawings.

FIG. 7 is a perspective view schematically illustrating an ejection mechanism 25, which is a main component of the label processing apparatus 1 according to Example 3, the view corresponding to FIG. 5 that illustrates the label processing apparatus 1 according to Example 1. Like numbers designate identical or corresponding component elements in Example 1, described above, and detailed description for such component elements are omitted.

Note that the label processing apparatus 1 according to Example 3 has a configuration similar to that of the label processing apparatus 1 according to Example 1, except that the label processing apparatus 1 according to Example 3 further includes a blown-substance receptacle 9 in the ejection mechanism 25.

As illustrated in FIG. 7, the label processing apparatus 1 according to Example 3 includes, in the label processing apparatus 1 according to Example 1, the blown-substance receptacle 9 configured to accommodate substances blown to an outside. This allows the generated substances having been ejected to the outside of the label processing apparatus 1 to be easily collected.

Here, the blown-substance receptacle 9 according to Example 3 is detachably configured with respect to the label punching device 3 (the first wall member 20). To describe in another way, the blown-substance receptacle 9 is provided attachably to and detachably from the label processing apparatus 1. Accordingly, the label processing apparatus 1 is configured such that a user easily disposes of the generated substances accumulated in the blown-substance receptacle 9.

Note that, as a configuration in which the blown-substance receptacle 9 is provided attachably to and detachably from the label processing apparatus 1 may be a configuration in which a part of the blown-substance receptacle 9 is detachably configured, that is, a configuration in which at least a part of the blown-substance receptacle 9 is detachably configured, in addition to the configuration in which the entirety of the blown-substance receptacle 9 is detachably configured as in Example 3.

Example 4 (FIGS. 8 to 12)

Hereinafter, a label processing apparatus 1 according to Example 4 will be described in detail with reference to the appended drawings.

The label processing apparatus 1 may have a configuration that includes a head 8 that performs scanning in the width direction B. In this case, a sliding contact section (contact section) is provided, which is configured to move in sliding contact with the surface of the transport path surface 13 accompanying with the scanning of the head 8. Accordingly, when the label medium M is on the surface of the transport path surface 13, the contact section moves in contact with the label medium M accompanying with the scanning of the head 8. This configuration causes the contact section and the fan 11 to more efficiently reduce dispersion of the generated substances.

Note that, the following descriptions will be given about a technology related to the head 8 that performs scanning in the width direction B to make the technology related to Example 4 recognizable, where the descriptions related to the fan 11 that have been described in Examples 1 to 3 are omitted.

Figure 8:
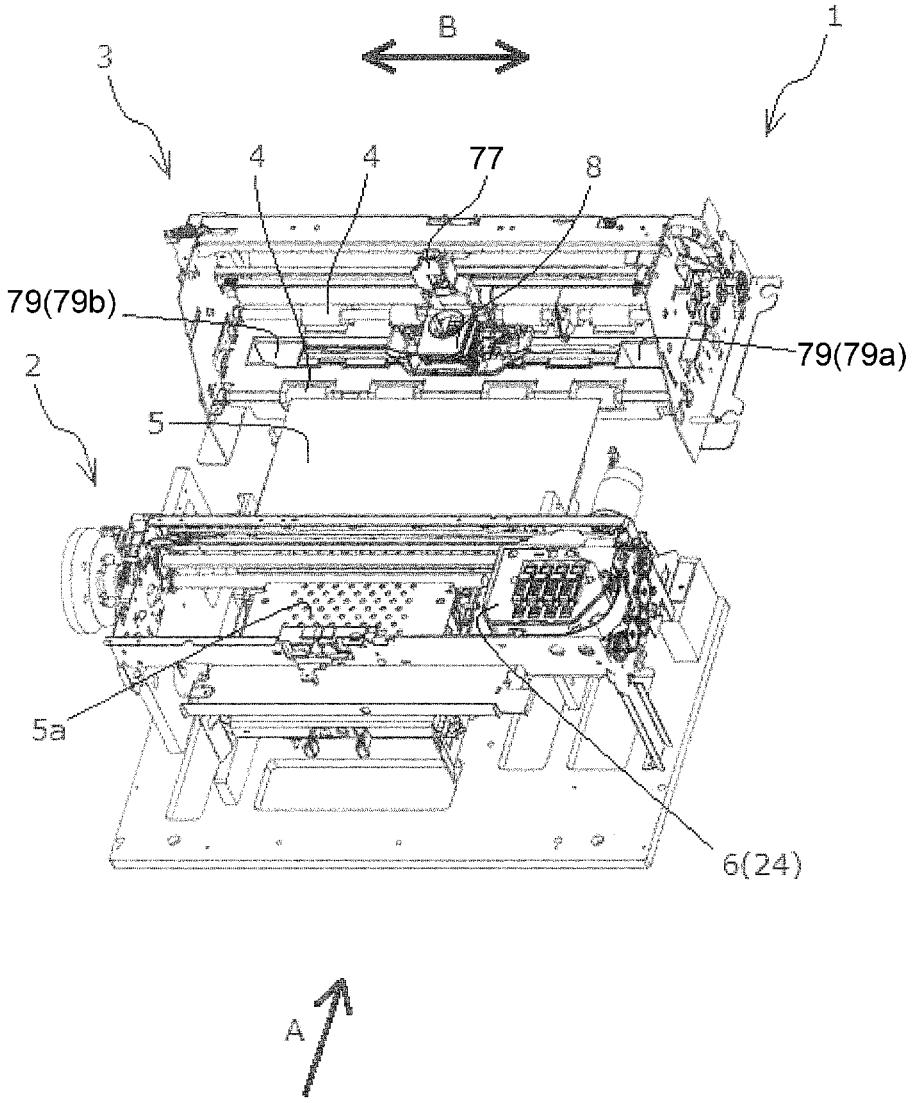
FIG. 8 is a perspective view schematically illustrating a label processing apparatus according to Example 4 of the disclosure.
Figure 9:
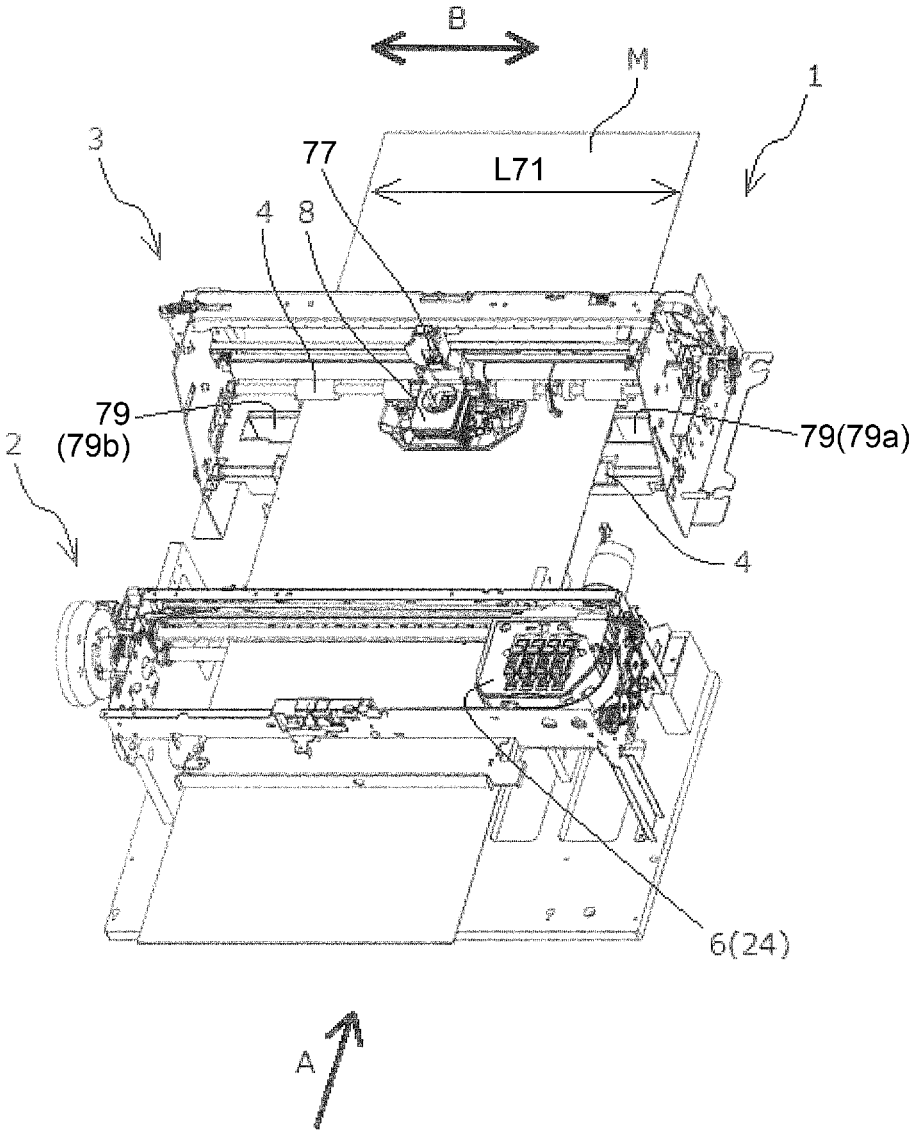
FIG. 9 is a perspective view schematically illustrating a label processing apparatus according to Example 4 of the disclosure.

FIGS. 8 and 9 are perspective views schematically illustrating the label processing apparatus 1 according to Example 4, where FIG. 8 illustrates a state where the label medium M is not set, and FIG. 9 illustrates a state where the label medium M of a width L71 is set. Note that as illustrated in FIG. 8, a suction hole 5*a* is formed through a portion of the support section 5 configured to suppress lifting of the label medium M being transported.

The label punching device 3 of the label processing apparatus 1 according to Example 4 includes a carriage 77, which is provided with the head 8 that causes the wire pin 10 (see FIG. 3) to move toward and away from the label medium M being transported, configured to perform processing on the label medium M. The carriage 77 is then configured to be moved back-and-forth (to perform reciprocating scanning) in the width direction B that intersects the transport direction A.

The label punching device 3 is configured to perform punching on the label medium M, causing the wire pin 10 to move toward and away from the label medium M being transported, while causing the carriage 77 to move back-and-forth in the width direction B. The label punching device 3 then repeatedly performs transporting of the label medium M at a predefined amount (by an amount corresponding to one pass in printing by the ink jet head 24) in the transport direction A, and controlling the head 8 to cause the head 8 to perform punching on the label medium M, and causing the carriage 77 to move in the width direction B in a state where the label medium M is stopped. This allows the label punching device 3 to perform punching on the label medium M into a desired shape.

Note that the label processing apparatus 1 is configured to intermittently transport the label medium M as described above, where the amount of one transport of the label medium M accompanying with the intermittent transportation and the timing of the transport match with each other between the printing device 2 and the label punching device 3. However, without being limited to such a configuration, the amount of one transport of the label medium M accompanying with the intermittent transportation and the timing of the transport may be different from each other between the printing device 2 and the label punching device 3. For example, a configuration may be employed, in which the label punching device 3 performs scanning of the carriage 77 one time whereas the printing device 2 performs scanning of the carriage 6 more than one time. A configuration may also be employed, in which the scanning timing of the carriage 6 and the scanning timing of the carriage 77 are totally different from each other, and the label medium M being transported by the roller 4 is stopped at both the scanning timing of the carriage 6 and the scanning timing of the carriage 77, or the like. A configuration may further be employed, in which the printing device 2 is a line printer, and the discharge of ink from the ink jet head 24 is stopped at the timing when the carriage 77 is scanned (at the timing when the label medium M being transported is stopped). In addition to the above, the label processing apparatus 1 may also be configured to provide a constant slack in the label medium M between the printing device 2 and the label punching device 3, and to then separately control transporting of the label medium M in the printing device 2 and transporting of the label medium M in the label punching device 3.

The carriage 77 is provided with a brush 711 (see FIG. 10) as a contact section that comes into contact with the label medium M when the carriage 77 performs scanning (performs collecting of the generated substances on the label medium M accompanying with the scanning of the carriage 77). A collection receptacle 79 configured to accommodate generated substances such as paper powder collected by the brush 711 accompanying with the scanning of the carriage 77 is then provided at an end portion in the width direction B of the label punching device 3.

The carriage 77 and the collection receptacle 79, which are main components of the label processing apparatus 1, will be described below in detail.

Next, a carriage 77, which is a main component of the label processing apparatus 1, will be described.

Here, the head 8 equipped in the carriage 77 has the configuration and function described with reference to FIG. 3.

Figure 10:
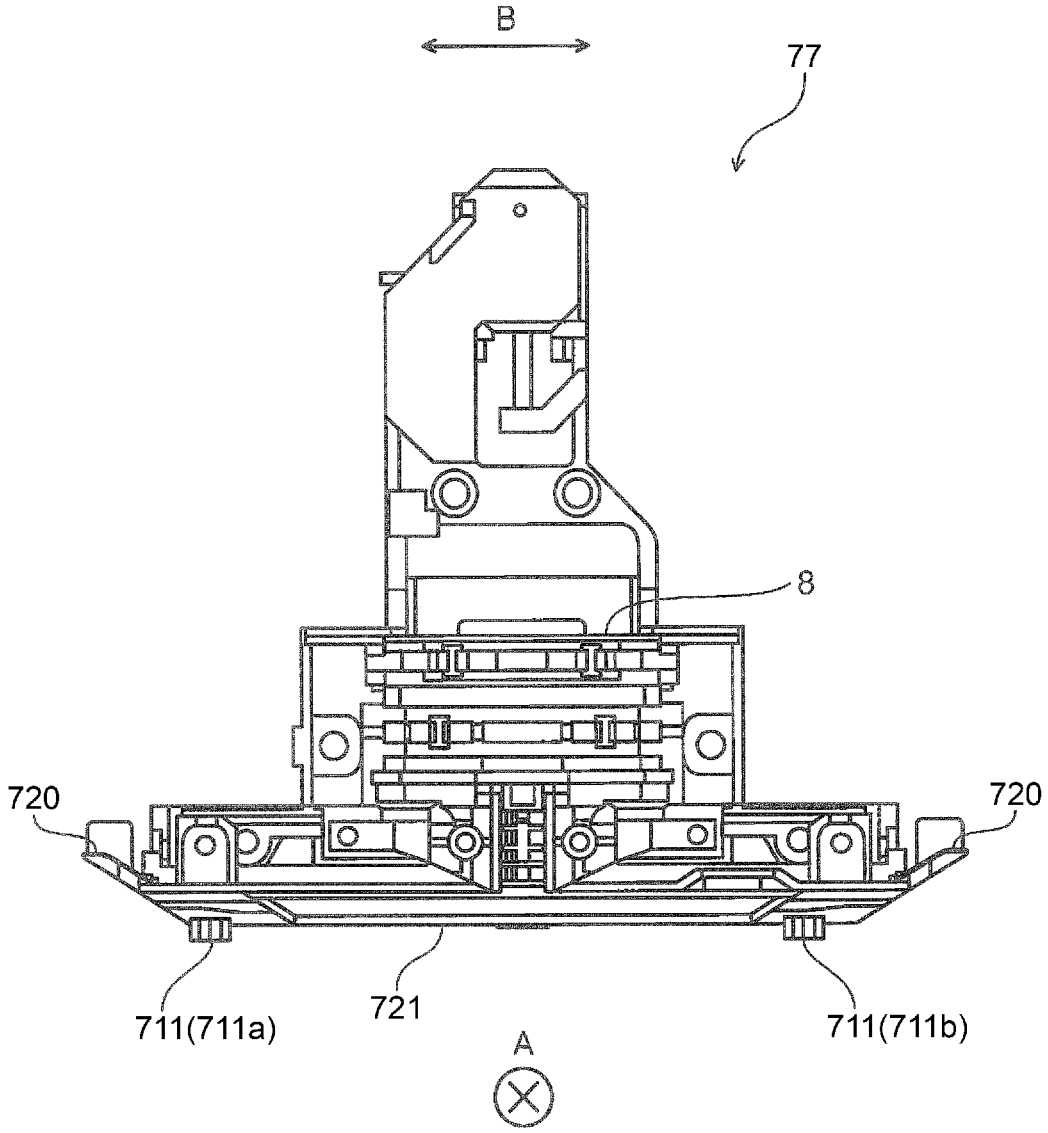
FIG. 10 is a front view schematically illustrating a main component of a label processing apparatus according to Example 4 of the disclosure.

FIG. 10 is a front view schematically illustrating the carriage 77.

As illustrated in FIG. 10, the carriage 77 includes brushes 711 that come into contact with the label medium M on both end portion sides in the width direction B of a lower surface 721 on the transport path surface 13 side, when the carriage 77 performs scanning in the width direction B. The carriage 77 includes guide sections 720 at both end portions in the width direction B of the carriage 77. The guide sections 720 suppress the label medium M from being caught on the carriage 77 accompanying with the reciprocating scanning of the carriage 77.

Next, the collection receptacle 79, which is a main component of the label processing apparatus 1, will be described in terms of the relationship with the carriage 77.

Figure 11:
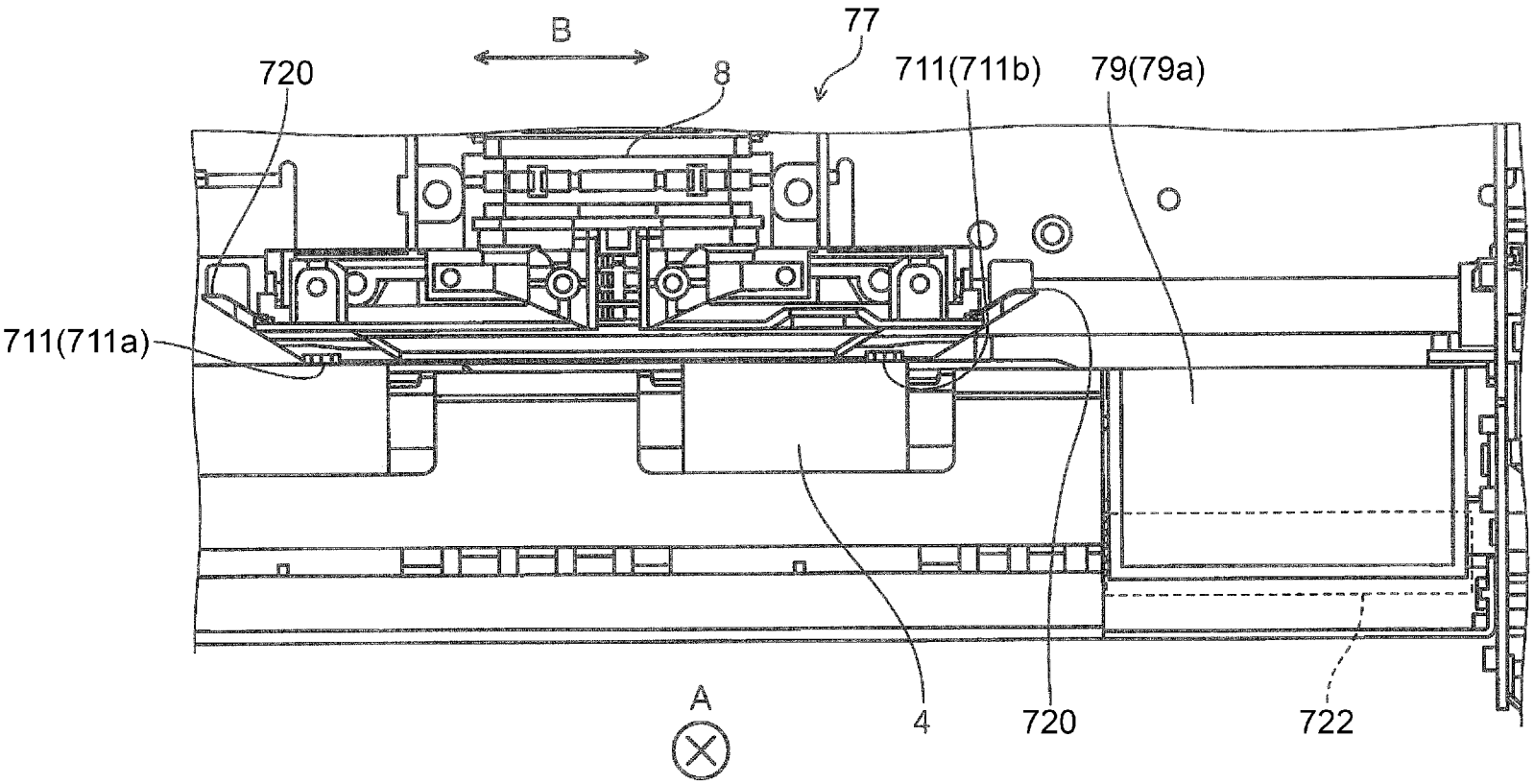
FIG. 11 is a front view schematically illustrating a main component of a label processing apparatus according to Example 4 of the disclosure.

Here, FIG. 11 is a front view schematically illustrating a formation region of a collection receptacle 79*a* of one of the two collection receptacles 79 provided in the label punching device 3.

Figure 12:
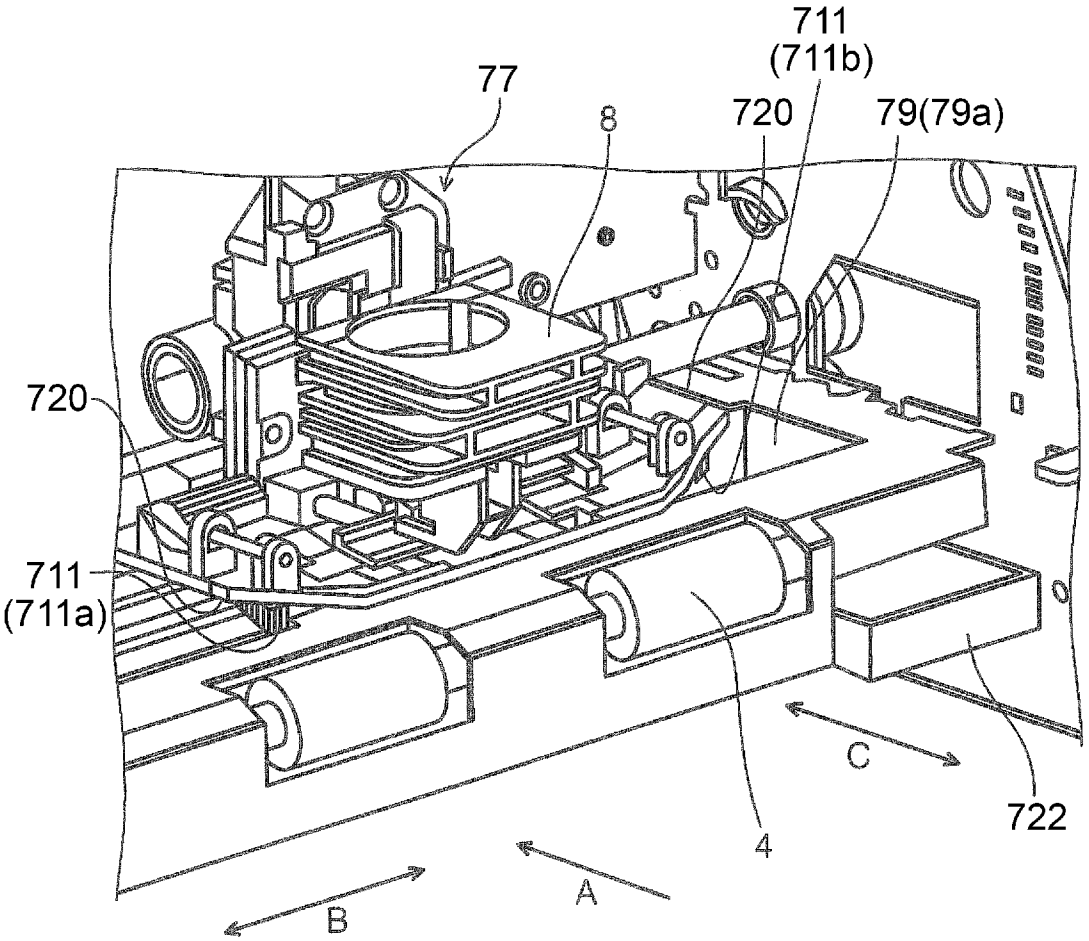
FIG. 12 is a perspective view schematically illustrating a main component of a label processing apparatus according to Example 4 of the disclosure.

FIG. 12 is a perspective view schematically illustrating the formation region of the collection receptacle 79 illustrated in FIG. 11.

As illustrated in FIGS. 8 and 9, the label punching device 3 includes the collection receptacle 79*a* provided on first side (the right side in a front view) in the width direction B with respect to a region where the label medium M is transported, and a collection receptacle 79*b* provided on the second side (the left side in a front view) in the width direction B with respect to the region where the label medium M is transported. That is, the label medium M is transported between the collection receptacle 79*a* and the collection receptacle 79*b* in the width direction B. As illustrated in FIGS. 10 and 11, in the carriage 77, a brush 711*a* located on the second side (the left side in a front view) in the width direction B and a brush 711*b* located on first side (the right side in a front view) in the width direction B are then provided as the brushes 711.

Here, the carriage 77 performs reciprocating scanning across the entire width in the width direction B of the label punching device 3. At this time, the carriage 77 performs scanning, at least, between a position at which the brush 711*a* faces the collection receptacle 79*a* and a position at which the brush 711*b* faces the collection receptacle 79*b*. Accordingly, during the reciprocating scanning of the carriage 77, when the carriage 77 moves from the collection receptacle 79*b* side to the collection receptacle 79*a* side in the width direction B, the generated substances such as paper powder collected by the brush 711*b* on the front side during the movement, as well as the generated substances collected by the brush 711*a* on the back side during the movement, are received by the collection receptacle 79*a*. Similarly, during the reciprocating scanning of the carriage 77, when the carriage 77 moves from the collection receptacle 79*a* side to the collection receptacle 79*b* side in the width direction B, the generated substances such as paper powder collected by the brush 711*a* on the front side during the movement, as well as the generated substances collected by the brush 711*b* on the back side during the movement, are received by the collection receptacle 79*b*. Accordingly, the label punching device 3 is configured to efficiently collect the generated substances such as paper powder with the brushes 711 at two locations during one scanning of the carriage 77.

As illustrated in FIGS. 11 and 12, the collection receptacle 79 is provided with a drawer section 722 movable in the insertion/removal direction C along the transport direction A. The user using the label processing apparatus 1 easily disposes of the generated substances accumulated in the collection receptacle 79 (the drawer section 722) by drawing out the drawer section 722 to take out the drawer section 722.

In summary, the label processing apparatus 1 includes the head 8 configured to cause the wire pin 10 to move toward and away from the label medium M being transported, the carriage 77 including the head 8 and configured to perform scanning in the width direction B that intersects the transport direction A of the label medium M, the brush 711 provided in the carriage 77 and configured to come into contact with the label medium M when the carriage 77 performs scanning in the width direction B, and the collection receptacle 79 configured to accommodate substances (generated substances such as paper powder) collected when the brush 711 comes into contact with the label medium M accompanying with the scanning of the carriage 77. The brush 711 is then configured to move from the end portion on one side (the first end portion), via the end portion on the other side (the second end portion), to the collection receptacle 79 in the width direction B of the label medium M (across the entire width of the label medium M), corresponding to the scanning of the carriage 77. As such, the label processing apparatus 1 is provided with, in the carriage 77 that performs scanning in the width direction B, the contact section (the brush 711) that comes into contact with the label medium M accompanying with the scanning of the carriage 77, and includes the collection receptacle 79 that accommodates substances collected when the contact section comes into contact with the label medium M. Accordingly, a configuration is provided such that the substances generated from the label medium M when punching of a label is performed are not only collected at the contact section (the brush 711), but are also accommodated in the collection receptacle 79. Thus, the configuration suppresses dispersion of the generated substances.

The label processing apparatus 1 also includes a printing device 2. That is, the label processing apparatus 1 further includes the ink jet head 24, and thus performs the print processing and the label processing together. As such, the label processing apparatus 1, which has a configuration in which the ink jet head 24 and the head 8 that causes the wire pin 10 to move forward and backward to perform processing on the label medium M is combined to be used, is configured to perform digital printing and digital processing, and forms a label having high accuracy in particular. Note that the ink jet head 24, which is susceptible to an adverse effect such as an generation of print defect when generated substances such as paper powder adheres to the ink jet head 24, is configured as described above, thus, the label processing apparatus 1 suppresses the generated substances from adhering to the ink jet head 24.

As illustrated in FIGS. 8 and 9, the collection receptacle 79 is provided at a position separated from the transport region where the label medium M is transported in the width direction B, and as illustrated in FIG. 12, the drawer section 722, which forms a part of the label processing apparatus 1, is provided attachably to and detachably from the label processing apparatus 1. This allows the label processing apparatus 1 to lower the possibility of the generated substances reaching the transport region. Also, a user using the label processing apparatus 1 easily disposes of the generated substances accumulated in the collection receptacle 79.

Note that a configuration, in which the drawer section 722 is provided attachably to and detachably from the label processing apparatus 1, may be a configuration in which the entirety of the collection receptacle 79 is detachably provided, in addition to the configuration in which a part of the collection receptacle 79 is detachably provided as in Example 4.

Also, as described above, the collection receptacle 79*a* and the brush 711*a* correspond to the collection receptacle 79*b* and the brush 711*b*, respectively, where the generated substances collected by the brush 711 on the back side during the reciprocating scanning of the carriage 77 are received into the collection receptacle 79. That is, the brush 711 is configured to come into contact with the label medium M at least on the side opposite to the side on which the collection receptacle 79 is located (on the back side with respect to the scanning of the carriage 77), when viewed from the head 8 in the width direction B. Such a configuration allows the label processing apparatus 1 to collect the generated substances at the brush 711 at the back side of the head 8 in the direction of the scanning of the carriage 77, accompanying with the scanning of the carriage 77. Accordingly, this is configured such that the substances generated from the label medium M, when the head 8 performs punching on a label, are efficiently collected.

The carriage 77 is also configured to perform reciprocating scanning across the entire width in the width direction B of the label punching device 3. According to such a configuration, when the carriage 77 is at the end portion on the collection receptacle 79*a* side, the brush 711*a* is located at a position at which the brush 711*a* can cause the collection receptacle 79*a* to receive the generated substances, and when the carriage 77 is at the end portion on the collection receptacle 79*b* side, the brush 711*b* is located at a position at which the brush 711*b* can cause the collection receptacle 79*b* to receive the generated substances. To describe in another way, the carriage 77 is configured to perform scanning between a first carriage position at which at least the brush 711 is located at the end portion on one side (for example, at which the brush 711*a* is located at the end portion on the collection receptacle 79*b* side) and a second carriage position at which the brush 711 is located at a receiving position (for example, a position at which the brush 711*a* causes the collection receptacle 79*a* to receive the generated substances) at which the collection receptacle 79 receives the generated substances. Thus, the label processing apparatus 1 is configured to be able to cause the collection receptacle 79 to accommodate the generated substances collected by the brush 711 due to the scanning of the carriage 77 (without involving further movement or the like of the brush 711 relative to the carriage 77 in addition to the scanning of the carriage 77).

However, the label processing apparatus 1 is not limited to such a configuration, and may be configured to involve further movement or the like of the brush 711 relative to the carriage 77 in addition to the scanning of the carriage 77.

Note that the relationship between the first carriage position and the second carriage position may be reversed from the relationship described above (a first carriage position at which the brush 711*a* is located at the end portion on the collection receptacle 79*a* side, and a second carriage position at which the brush 711*a* causes the collection receptacle 79*b* to receive the generated substances).

As described above, the contact section in the label processing apparatus 1 is the brush 711. This allows the contact section to be simply configured and to be attached to the carriage 77 with ease.

However, the contact section may be configured with a member other than the brush 711.

Figure 13:
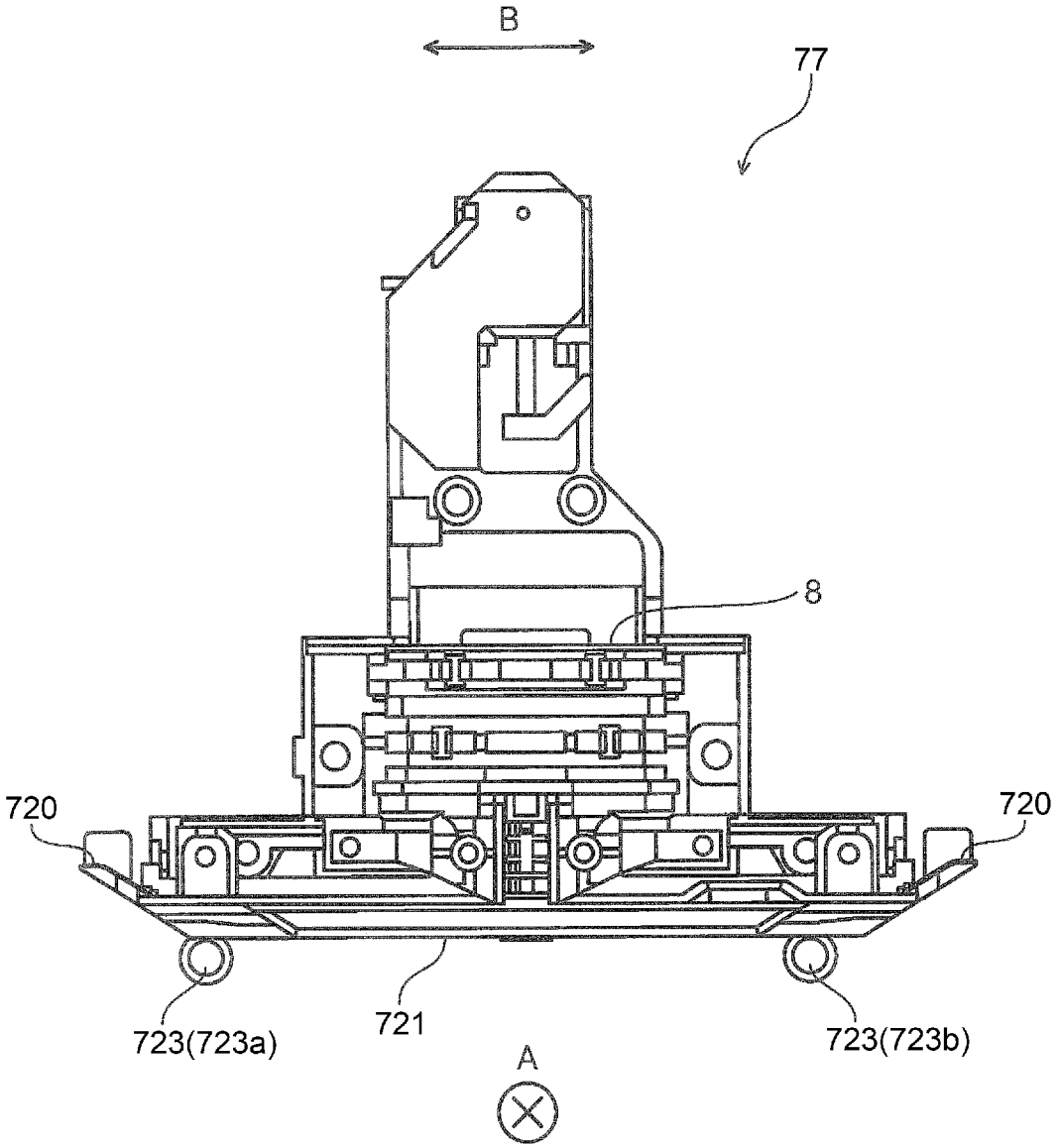
FIG. 13 is a front view schematically illustrating a main component of a label processing apparatus according to Example 5 of the disclosure.

Example 5 (FIG. 13)

Hereinafter, a label processing apparatus 1 according to Example 5 will be described in detail with reference to the appended drawings.

FIG. 13 is a front view schematically illustrating the carriage 77, which is a main component of the label processing apparatus 1 according to Example 5, the view corresponding to FIG. 10 that illustrates the label processing apparatus 1 according to Example 4. Like numbers designate identical or corresponding component elements in Example 4, described above, and detailed description for such component elements are omitted.

Note that the label processing apparatus 1 according to Example 5 has a configuration similar to that of the label processing apparatus 1 according to Example 4, excluding the contact section provided on the carriage 77.

As illustrated in FIG. 13, the contact section according to Example 5 is a roller member 723. This causes an increase in load when scanning of the carriage 77 is performed to be reduced.

Here, a roller member 723*a* of the roller member 723 is provided at a position similar to the position of the brush 711*a*, and a roller member 723*b* of the roller member 723 is provided at a position similar to the position of the brush 711*b*. That is, the collection receptacle 79*a* and the roller member 723*a* correspond to the collection receptacle 79*b* and the roller member 723*b*, respectively.

Note that the label processing apparatus 1 according to Example 5 is configured to include the collection receptacle 79 at a position similar to that of the label processing apparatus 1 according to Example 4, however, the configuration may also be a configuration in which a suction hole is provided in the roller member 723 and a suction mechanism is provided inside the roller member 723, for example. In this configuration, the roller member 723 concurrently serves as the collection receptacle 79 that accommodates the generated substances.

Figure 14:
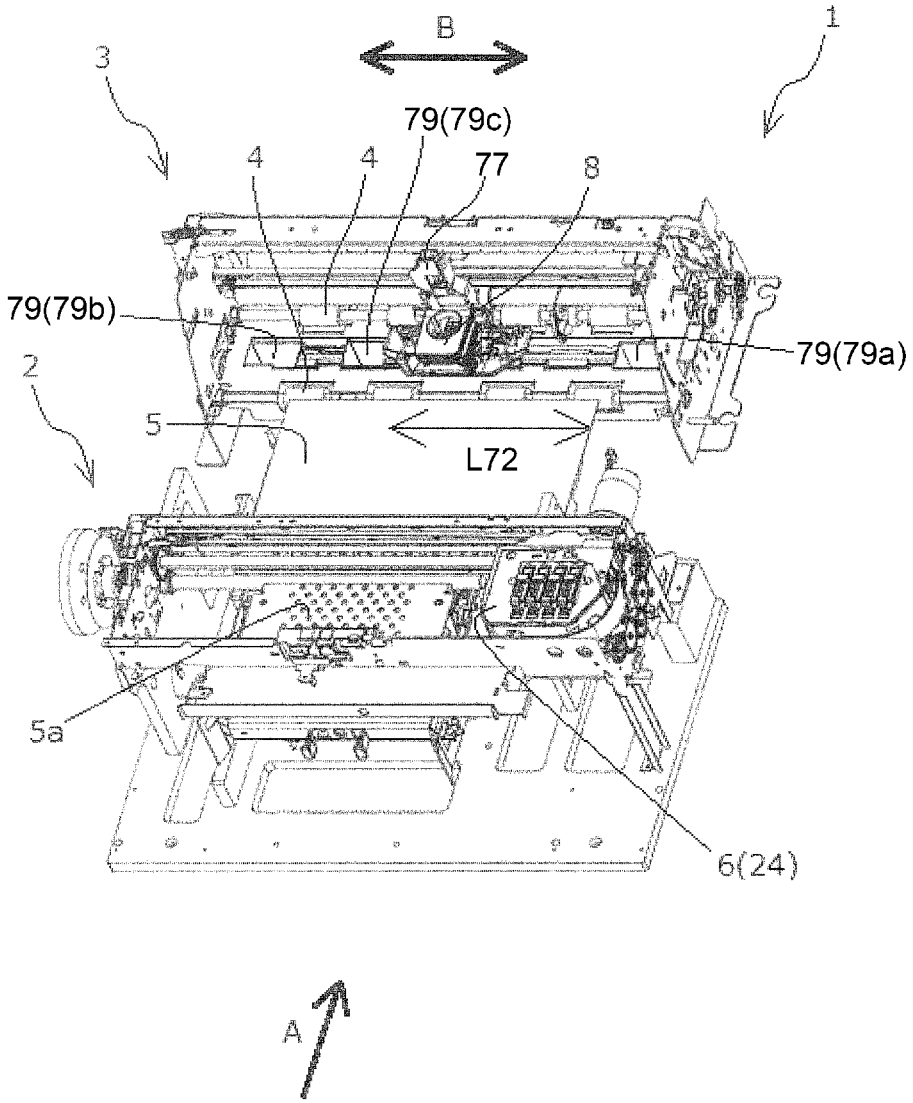
FIG. 14 is a perspective view schematically illustrating a label processing apparatus according to Example 6 of the disclosure.

Example 6 (FIG. 14)

Hereinafter, a label processing apparatus 1 according to Example 6 will be described in detail with reference to the appended drawings.

FIG. 14 is a perspective view schematically illustrating the label processing apparatus 1 according to Example 6, the view corresponding to FIG. 8 that illustrates the label processing apparatus 1 according to Example 4. Like numbers designate identical or corresponding component elements in Example 4, described above, and detailed description for such component elements are omitted.

Note that the label processing apparatus 1 according to Example 6 has a configuration similar to that of the label processing apparatus 1 according to Example 4, excluding the configuration of the collection receptacle 79.

The label processing apparatus 1 according to Example 4 is assumed to use the label medium M of the width L71. Accordingly, as illustrated in FIG. 9, a configuration is employed, in which when the label medium M of the width L71 is set, the collection receptacle 79 (the collection receptacle 79*a* and the collection receptacle 79*b*) is located outside of both end portions in the width direction B of the label medium M.

On the other hand, the label processing apparatus 1 according to Example 6 is configured to use the label medium M of the width L72 in addition to the label medium M of the width L71. Accordingly, even when the label medium M of the width L72 is set, this is configured such that the collection receptacle 79 (the collection receptacle 79*a* and the collection receptacle 79*c*) is located outside of both end portions in the width direction B of the label medium M, as illustrated in FIG. 14.

Note that the disclosure is not limited to the aforementioned example, and many variations are possible within the scope of the disclosure as described in the appended claims. It goes without saying that such variations also fall within the scope of the disclosure.

For example, the label processing apparatus 1 according to Example 4 includes two collection receptacles 79 and the label processing apparatus 1 according to Example 6 includes three collection receptacle 79, but the label processing apparatus 1 may be configured to include one collection receptacle 79, or include four or more collection receptacles 79. A configuration may be employed, in which the blown-substance receptacle 9 also serves as the collection receptacles 79. Every one of the label processing apparatuses 1 according to Examples 4 to 6 includes two contact sections (the brush 711 and the roller member 723), but each of the label processing apparatuses 1 may be configured to include one contact section, or include three or more contact sections. The label processing apparatuses 1 in Examples may include contact sections of different types, such as, for example, contact sections including both the brush 711 and the roller member 723.

INDUSTRIAL APPLICABILITY

The disclosure has utility in a label processing apparatus that performs punching on a label out of a label medium, and suppresses dispersion of paper powder generated due to the punching of the label.

REFERENCE SIGNS LIST

1 . . . Label processing apparatus, 2 . . . Printing device, 3 . . . Label punching device, 4 . . . Roller, 5 . . . Support section, 5*a* . . . Suction hole, 6 . . . Carriage, 7 . . . Duct cover, 7*a* . . . First surface, 7*b* . . . Second surface, 7*c* . . . Third surface (Cover section), 8 . . . Head, 9 . . . Blown-substance receptacle, 10 . . . Wire pin, 10A . . . Retracted position, 10B . . . Advanced position, 11 . . . Fan (Air blower), 12 . . . Wire dot head, 13 . . . transport path surface, 14 . . . Head surface, 15 . . . Wire pin movement mechanism, 16 . . . Drive plate, 17 . . . Actuator, 18 . . . Drive coil, 19 . . . Biasing member, 20 . . . First wall member, 21 . . . Second wall member, 22 . . . First communication hole, 23 . . . Second communication hole, 24 . . . Ink jet head, 25 . . . Ejection mechanism, 26 . . . Third communication hole, 77 . . . Carriage, 79 . . . Collection receptacle, 79*a* . . . Collection receptacle, 79*b* . . . Collection receptacle, 79*c* . . . Collection receptacle, 711 . . . Brush, 711*a* . . . Brush, 711*b* . . . Brush, 720 . . . Guide section, 721 . . . Lower surface of Carriage 77, 722 . . . Drawer section, 723 . . . Roller member, 723*a* . . . Roller member, 723*b* . . . Roller member, L1 . . . Gap between transport path surface 13 and First surface 7*a* in Duct cover 7, L2 . . . Gap between transport path surface 13 and Second surface 7*b* in Duct cover 7, M . . . Label medium, S . . . Ventilation region, L71 . . . Width of Label medium M, L72 . . . Width of Label medium M

The invention claimed is:

1. A label processing apparatus comprising:

a head configured to cause a wire pin to move toward and away from a label medium, which is being transported, for performing processing on the label medium;

a first wall member located at a position that is in a first direction from a transport path, the transport path being where the label medium is transported, the first direction being along a width direction intersecting a transport direction in which the label medium is transported, the first wall member including a first communication hole;

an air blower configured to blow air onto a ventilation region including a region where the head is located and then cause the air to be discharged through the first communication hole;

a second wall member located at a position that is in a second direction from the transport path, the second direction being along the width direction and opposite the first direction; and a duct cover coupled to the first wall member and to the second wall member and extending in a direction intersecting a transport path surface, the duct cover including a first surface, wherein the ventilation region and the first communication hole are located at a side, at which the head is located, of the first surface in the transport direction.

2. The label processing apparatus according to claim 1, wherein the duct cover includes:

a second surface coupled to the first wall member and to the second wall member and extending in a direction intersecting the transport path surface, and a cover section coupled to the first surface and to the second surface, and the head and the ventilation region are located on the inside of the duct cover including the first surface, the second surface, and the cover section.

3. The label processing apparatus according to claim 2, comprising an ink jet head, wherein the first surface is located between the ink jet head and the head in the transport direction, and a flow rate of gas leaking through a gap between the transport path surface and the first surface in the duct cover is less than a flow rate of gas leaking through a gap between the transport path surface and the second surface in the duct cover.

4. The label processing apparatus according to claim 3, wherein the gap between the transport path surface and the first surface in the duct cover is narrower than the gap between the transport path surface and the second surface in the duct cover.

5. The label processing apparatus according to claim 1, wherein the second wall member includes a second communication hole configured to communicate with outside of the ventilation region and inside of the ventilation region, and the air blower is located at a position that is in the second direction from the transport path, takes in air from the outside through the second communication hole, and then causes the air to be discharged to the outside through the first communication hole.

6. The label processing apparatus according to claim 1, wherein the second wall member includes a second communication hole configured to communicate with outside of the ventilation region and inside of the ventilation region, the duct cover includes a third communication hole configured to communicate with outside of the ventilation region and inside of the ventilation region, and the air blower takes in air from the outside through the third communication hole and then causes the air to be discharged to the outside through the first communication hole and the second communication hole.

7. The label processing apparatus according to claim 1, further comprising a blown-substance receptacle configured to accommodate a substance that was blown to the outside, wherein at least a part of the blown-substance receptacle is provided attachably to and detachably from the label processing apparatus.

8. The label processing apparatus according to claim 1, comprising:

a carriage including the head and configured to perform scanning in the width direction;

a contact section provided in the carriage and configured to come into contact with the label medium when the carriage performs scanning in the width direction; and a collection receptacle configured to accommodate a substance collected by the contact section that moves while being in contact with the label medium as the carriage performs scanning, wherein the contact section is configured, when moving from a position where the contact section comes into contact with a first end of an end portion of the label medium in the width direction to a second end portion side located further toward a collection receptacle side than the first end portion, to move to the collection receptacle, corresponding to the scanning of the carriage.

9. The label processing apparatus according to claim 8, wherein the collection receptacle is provided at a position separated from the transport path in the width direction, and at least a part of the collection receptacle is provided attachably to and detachably from the label processing apparatus.

10. The label processing apparatus according to claim 9, wherein the head is located between the contact section and the collection receptacle in the width direction.

11. The label processing apparatus according to claim 8, wherein the carriage is configured to perform scanning between a first carriage position where the contact section comes into contact with the first end portion of the label medium and a second carriage position where a part of the contact section faces the collection receptacle.

12. The label processing apparatus according to claim 8, wherein the contact section is a brush.

13. The label processing apparatus according to claim 8, wherein the contact section is a roller member.

* * * * *